US006840515B2

(12) United States Patent
Seme

(10) Patent No.: US 6,840,515 B2
(45) Date of Patent: Jan. 11, 2005

(54) TABLE GAME

(76) Inventor: David J. Seme, 2804 Kapalua Ct., Freehold, NJ (US) 07728

( * ) Notice: Subject to any disclaimer, the term of this patent is extended or adjusted under 35 U.S.C. 154(b) by 0 days.

(21) Appl. No.: 10/786,500

(22) Filed: Feb. 25, 2004

(65) Prior Publication Data

US 2004/0173961 A1 Sep. 9, 2004

Related U.S. Application Data

(60) Provisional application No. 60/451,429, filed on Mar. 4, 2003.

(51) Int. Cl.[7] ..... A63F 7/00
(52) U.S. Cl. ..... 273/118 R
(58) Field of Search ..... 273/108, 118 R, 273/118 A, 119 R, 119 A, 127 R, 127 B

(56) References Cited

U.S. PATENT DOCUMENTS 514,688 A * 2/1894 Starks ..... 273/118 R
1,681,590 A * 8/1928 Marczinko ..... 473/107
3,704,889 A * 12/1972 Huffman et al. ..... 273/119 R
4,113,255 A * 9/1978 Goldfarb et al. ..... 273/108
4,407,501 A * 10/1983 Bates ..... 273/118 R
5,354,058 A * 10/1994 Crecelius ..... 273/120 R
5,516,102 A * 5/1996 Polk et al. ..... 273/119 R

* cited by examiner

*Primary Examiner*—Raleigh W. Chiu
(74) *Attorney, Agent, or Firm*—Clilfford G. Frayne

(57) ABSTRACT

A free standing table game of skill utilizing a spherical ball and a plurality of pins, the free standing table game having a support frame supporting a playing surface oblong in shape having a centrally disposed planar portion, a first end having an upstanding arcuate portion spanning the length of the first end terminating at its upper edge in a planar scoring surface, the second end having upstanding arcuate corners at 45 degree angles with the second end and the longitudinal edges, the longitudinal edges and the second end of the playing surface having a gutter periphery for retention of the spherical ball upon leaving the playing surface, the playing surface preferably covered with a felt-like material and having a plurality of different indicia positionable thereon for the positioning of a plurality of markers in a desired formation from a section of formations dependent upon said indicia, the markers to be engaged and displaced by the spherical playing ball launched from the first end of the table game and utilizing the arcuate surfaces at the first end and corners of the second end to guide the spherical ball for engagement with a selected marker or markers until the ball comes to rest on either the playing surface or gutter periphery.

8 Claims, 3 Drawing Sheets

TABLE GAME

RELATED APPLICATIONS

This application claims the benefit of provisional application Ser. No. 60/451,429, filed Mar. 4, 2003.

BACKGROUND OF THE INVENTION

1. Field of the Invention

The present invention relates to a free standing table game of skill utilizing a spherical ball and a plurality of markers, for example, upstanding pins, wherein the playing surface comprises a planar portion and a plurality of arcuate portions.

2. Description of the Prior Art

There are a plurality of free standing table games available in the market place. The game of pool and billiards are played on a free standing table having a planar surface and a plurality of pockets utilizing a cue stick and a plurality of spherical balls. Snooker is similarly played on a planar table with a cue stick and a plurality of spherical balls, albeit on a table larger than a pool or billiard table. Bumper pool is a free standing game of skill played on a planar surface with cue sticks, a plurality of spherical balls, and a plurality of fixed bumper pins displaced about the pocket. Shuffleboard is a freestanding game of skill played on a longitudinal, planar surface surrounded by a gutter and utilizing a plurality of disks or pucks.

The commonality associated with the aforesaid games is that they are played on a planar surface which requires the player's skill to be exhibited in a planar or XY plane. There has long been a need for a free standing game of skill which requires the skill to be exhibited in the "XYZ" planes, that is a game of skill played simultaneously on a planar and non-planar or arcuate surface. Applicant's game answers this need in the free standing table game of skill category.

Applicant's table game is designed for commercial use such as pubs, lounges, cruise ships, casinos and the like. It may also be scaled down so as to be less expensive and within a price range suitable for the average family home or den.

The game is designed to develop skills that utilize the basic principles of gravity and geometry to control the speed and direction of the ball. Any point within the main play area may be reached by using any combination of the inclines and the different directions which they face, and the intended height the ball rolls up any of the inclines and the angle which the ball is launched is controlled by the player. Although previous concepts involve the reversal of ball direction, they return the ball to an area or plane different from that of the launch area where the ball originates. Applicant's table game is unique in that it is the players intention to reach the final ball destination back within the main play area where the ball is launched by utilizing combinations of the various inclines. Still further, the number of inclines utilized on a single pass can add to the scoring of the game.

OBJECTS OF THE INVENTION

An object of the present invention is to provide for a novel free standing table game of skill in which the playing surface incorporates a planar portion and an arcuate portion.

A still further object of the present invention is to provide for a novel free standing table game of skill which requires the user to utilize the skill on a playing surface having X, Y, and Z coordinates.

A still further object of the present invention is to provide for a novel free standing table game in which multiple players may compete against each other or the house.

SUMMARY OF THE INVENTION

A free standing table game of skill utilizing a spherical ball and a plurality of markers, the free standing table game having a support frame supporting a playing surface oblong in shape having a centrally disposed planar portion, a first end having an upstanding arcuate portion spanning the length of the first end terminating at its upper edge in a planar scoring surface, the second end having upstanding arcuate corners at 45 degree angles with the second end and the longitudinal edges, the longitudinal edges and the second end of the playing surface having a gutter periphery for retention of the spherical ball upon leaving the playing surface, the playing surface preferably covered with a felt-like material and having a plurality of different indicia positionable thereon for the positioning of a plurality of markers in a desired formation from a section of formations dependent upon said indicia, the markers to be engaged and displaced by the spherical ball launched from the first end of the table game and utilizing the arcuate surfaces at the first end and corners of the second end to guide the spherical ball for engagement with a selected marker or markers until the ball comes to rest on either the playing surface or gutter periphery.

BRIEF DESCRIPTION OF THE DRAWINGS

These and other objects of the present invention will become evident particularly when taken in light of the following illustrations wherein.

DETAILED DESCRIPTION OF THE DRAWINGS

Figure 1:
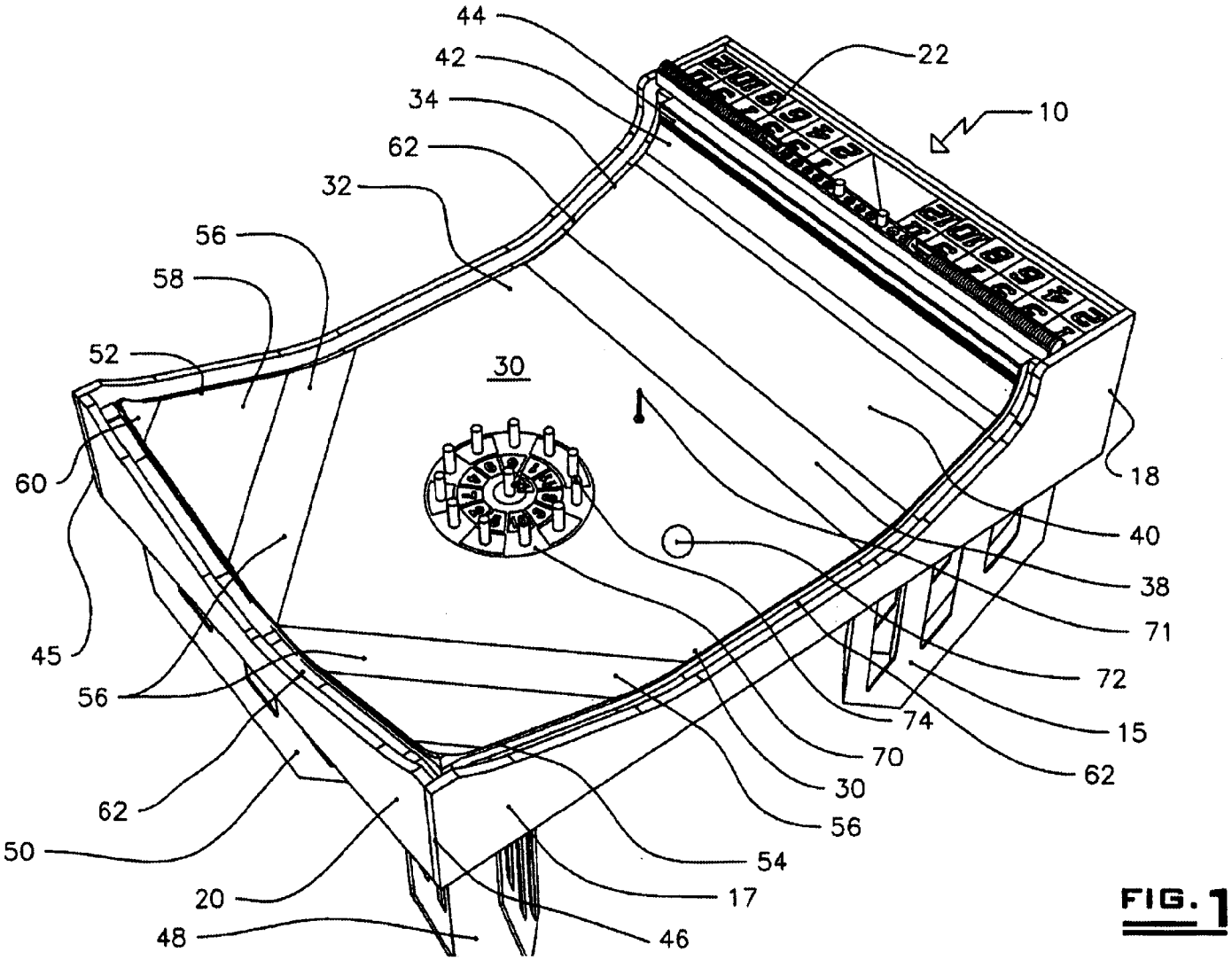
FIG. 1 is a perspective view from a corner of the second end of the free standing table game.
Figure 2:
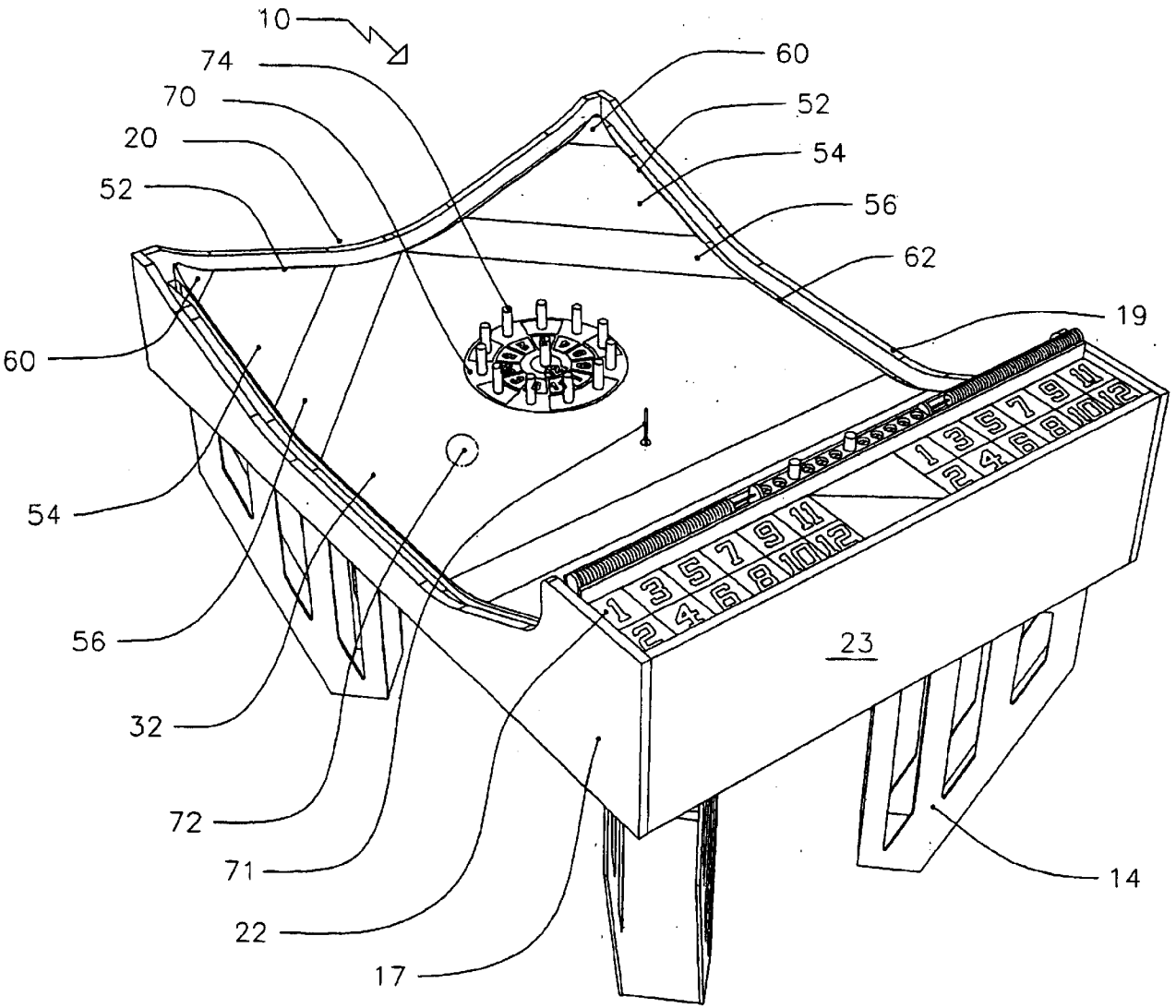
FIG. 2 is a perspective view from a corner of the first end of the free standing table game.

FIGS. 1 and 2 are perspective views of the table game 10 from opposing ends. Table game 10 in the preferred free standing embodiment would have, as shown in FIG. 2, a plurality of interconnected leg members 14. Leg members 14 would support a support member 16 at approximately normal table height (approximately 30 inches). Support member 16 would be generally rectangular in shape having a first end 18 and a second end 20. Support member 16 would also be comprised of side walls 17 and 19 and end walls 21 and 23. At first end 18, end wall 23 and a portion of side walls 17 and 19 would extend upwardly and be capped by a planar players stand 22 on which would be positioned the scoring or betting indicia for the game. Additionally, side walls 17 and 19 would be flared upwardly proximate second end 20 and end wall 21 would be flared upwardly where its intersection with sidewalls 17 and 19 occurred. The playing surface 30 would be positioned on support member 16 and extend from the player stand 22 to proximate second end 20.

The playing surface 30 positioned on planar support 16 would comprise a generally planar portion 32 and first arcuate section 34 extending across the width of first end 18 and extending upwardly from the planar portion 32 to the player stand 22. The arcuate section is a combination of a first concave surface 38 at the base of the arcuate section and a flat surface 40 beginning at the top of the concave surface 38 angled upwardly terminating with a second concave surface 42 angled upwardly terminating in a planar portion 44 which abuts the planar player stand 22.

The playing surface 30 extends to second end 20 of table game 10. There is secured at second end 20, at corners 45 and 46, on support member 16, a pair of arcuate incline supports 48 and 50 formed at a 45 degree angle with the longitudinal axis of table game 10. The playing surface 30 extends arcuately upwardly on supports 48 and 50 forming a triangular shape playing surface 52 and 54 in each of the corners 45 and 46. The corner playing surfaces are comprised of an arcuate portion 56 commencing from the planar portion 32 of the playing surface 30, this concave portion melding into a planar incline portion 58 which melds into an upper concave terminus portion 60. The playing surface therefore comprises the arcuate section 34 at first end 18 of table game 10, the planar portion 32, and the arcuate triangle portions 52 and 54 at second end 20 of table game 10. There is positioned about the longitudinal edges of planar portion 32 a stepped down gutter member 62 between the playing surface 30 and the sidewalls 17, 19, 21 and 23, which follows the contours of the edges and provides an element of containment during the play of the game for the spherical ball should it in the course of its travel attempt to leave the playing surface 30.

Figure 3:
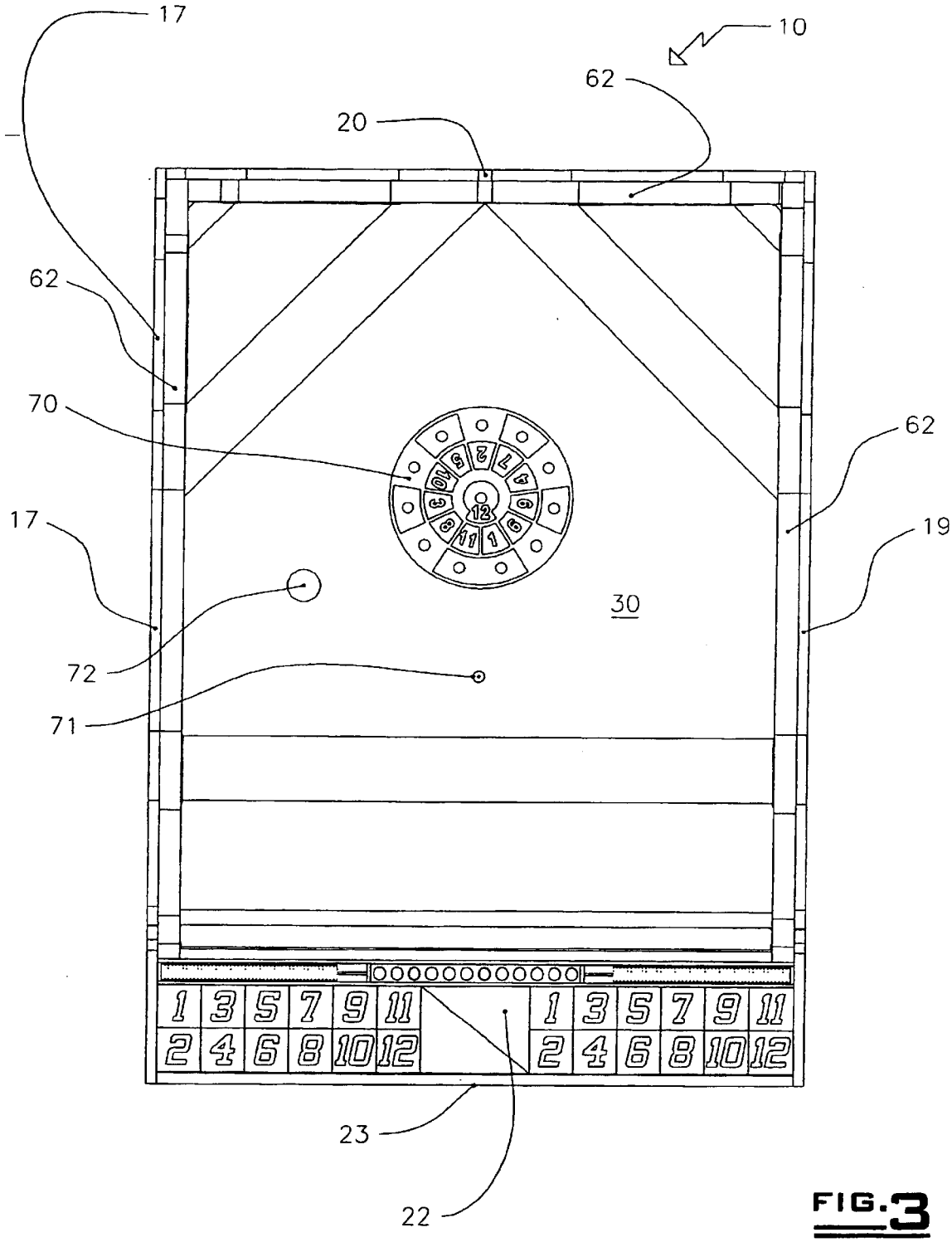
FIG. 3 is a top view of the free standing table game.

FIG. 3 is a top view of table game 10. In FIG. 3 there is illustrated the table game 10 with the playing instruments. In FIG. 3, the planar portion 32 of playing surface 30 is illustrated with a plurality of indicia 70 forming a pattern. In this particular embodiment, the pattern is a plurality of indicia forming a circle with a single indicia positioned at the hub of the circle. The playing implement in the form of a spherical ball 72 is also shown on the playing surface 32.

In one embodiment of the game, the markers comprise pins 74, one half of the pins 74 are one color and one half of the pins 74 are a separate color, one color being labeled with odd integers and the opposing color being numbered with even integers. Due to the fact that the playing surface is three dimensional, the player would launch the ball from the first end 18 of the table game toward arcuate section 34 passing over planar portion 32. Depending on the speed and direction of the ball, it would return to the planar portion 32 and pass up the arcuate section 52 or 54 or both, and possibly change direction again. In one manner of play, the object of the game would be for one player to knock down his designated pins (odd or even) and culminate the game by knocking down the center pin (similar to the pool game of Eight Ball). Obviously variations of the game are possible without departing from the spirit and scope of the invention, which is a table game of skill played in three dimensions. Still further, additional indicia may be utilized to position pins such that the table surface could be utilized to mimic additional games such as bowling or bocce with the introduction of a curved surface. Still further, the planar playing surface may be formed with one or more pluggable bore for the removable receipt of one or more stationary obstacle pins 71. Still further, markers in a form other than pins may be utilized such as spheres of different color.

While the present invention has been described with respect to a stand alone unit having its own support frame 12, it will be recognized by those of ordinary skill in the art that the table game 10 may be fabricated without support frame 12 such that its support member 16 and playing surface 30, together with player stand 22, could be positioned on a normal table or over a billiard table or on a ping pong table without departing from the spirit and scope of the invention.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A free standing table game of skill comprising:

a support frame;

a playing surface positioned on said support frame, said playing surface having a first end wall, second end wall and opposing side walls defining a plurality of playing surfaces including a planar centrally disposed playing surface;

a first arcuate concave playing surface spanning said first end of said playing surface and terminating with a first end having a player scoring surface and at a second end with said planar centrally disposed playing surface;

a pair of second arcuate concave playing surfaces formed at the intersection of said sides and said second end;

a plurality of indicia positioned of said central playing surface forming a pattern for positioning of a plurality of markers thereon;

a spherical playing ball released from said first end arcuate playing surface under the influence of gravity and utilizing said first arcuate concave playing surface, said second arcuate concave playing surfaces and said planar central playing portion to engage and displace said markers;

means for keeping score on said player scoring surface.

2. The freestanding table game of skill in accordance with claim 1 wherein said side walls and said second end wall are formed with stepped down gutters and side walls to retain said spherical playing ball if said spherical playing ball leaves said playing surface.

3. The freestanding table game of skill in accordance with claim 1 wherein said markers comprise of free standing pins.

4. The freestanding table game of skill in accordance with claim 1 wherein said markers comprise displaceable spheres of a color different from said playing ball.

5. The freestanding table game of skill in accordance with claim 1 wherein said indicia are repositionable on said playing surface to form an alternative pattern for said markers.

6. The freestanding table game of skill in accordance with claim 1 wherein said playing surface is formed of a solid material.

7. The freestanding table game of skill in accordance with claim 5 wherein said playing surface is covered with felt.

8. The freestanding table game of skill in accordance with claim 1 wherein said playing surface is formed with a plurality of random bores for the receipt of stationary, non-displaceable pins affecting the path of said spherical ball.

* * * * *